US008578523B2

(12) United States Patent
Eichler et al.

(10) Patent No.: US 8,578,523 B2
(45) Date of Patent: Nov. 12, 2013

(54) VANDAL-PROOF FLOOR SINK STRAINER

(75) Inventors: Ben Eichler, Erie, PA (US); Douglas R. Wroblewski, Erie, PA (US); Joseph Tripodi, Erie, PA (US)

(73) Assignee: Zurn Industries, LLC, Erie, PA (US)

( * ) Notice: Subject to any disclaimer, the term of this patent is extended or adjusted under 35 U.S.C. 154(b) by 1566 days.

(21) Appl. No.: 12/050,198

(22) Filed: Mar. 18, 2008

(65) Prior Publication Data

US 2008/0295236 A1 Dec. 4, 2008

Related U.S. Application Data

(60) Provisional application No. 60/932,543, filed on May 31, 2007.

(51) Int. Cl.
*A47K 1/14* (2006.01)
*E03C 1/26* (2006.01)

(52) U.S. Cl.
USPC ..... 4/292; 4/286; 4/288

(58) Field of Classification Search
USPC ..... 4/286, 287, 290, 292, 288, 289, 291, 4/673, 680
See application file for complete search history.

(56) References Cited

U.S. PATENT DOCUMENTS

| | | | | |
|---|---|---|---|---|
| 5,728,294 | A * | 3/1998 | Deming | 210/164 |
| 6,092,244 | A * | 7/2000 | Rizzardi et al. | 4/286 |
| 6,165,357 | A * | 12/2000 | Cormier | 210/163 |
| 6,330,724 | B1 * | 12/2001 | Belle | 4/288 |
| 6,567,996 | B2 * | 5/2003 | Rao | 4/286 |
| 6,588,029 | B2 * | 7/2003 | Mullings | 4/507 |
| 2005/0016092 | A1 * | 1/2005 | Whitworth | 52/204.1 |

* cited by examiner

*Primary Examiner* — Katherine Mitchell
*Assistant Examiner* — Jeremy Ramsey
(74) *Attorney, Agent, or Firm* — The Webb Law Firm

(57) ABSTRACT

A floor sink strainer arrangement adapted to fasten to a receptacle body of a floor sink. The strainer arrangement includes a strainer having a body and defining a slot therein for receiving a fastener, and a fastener arrangement attached to the strainer. The strainer is adapted to be received within the receptacle body of the floor sink. The fastener arrangement includes a support base and a longitudinal extending member attached to the base and extending therefrom, wherein the base is adapted to be secured to a drain pipe when the strainer is received within the receptacle body of the floor sink.

8 Claims, 15 Drawing Sheets

VANDAL-PROOF FLOOR SINK STRAINER

CROSS REFERENCE TO RELATED APPLICATION

This application claims the benefit of U.S. Provisional Application No. 60/932,543 entitled "Vandal-Proof Floor Sink Strainer," filed on May 31, 2007, which is hereby incorporated by reference.

BACKGROUND OF THE INVENTION

1. Field of the Invention

The present invention relates to floor sinks and, more particularly, to a vandal-proof floor sink strainer.

2. Description of Related Art

Presently, floor sinks are initially installed utilizing a receptacle body that can receive either a dome or planer shaped strainer. Such prior art floor sink arrangements are manufactured, for example, by Zurn Industries, Inc., under the product No. FD2375.

Referring to FIG. 1, a typical prior art floor sink 10 includes a receptacle body 12 having a open first portion 14 and a pipe receiving second portion 22 adapted to fasten to a drain pipe P (shown in FIG. 3). The first portion 14 has an upper end 16 and a lower end 18 and defines a body cavity 20 therein. The second portion 22 has an inlet end 24 and an outlet end 26 and defines a passageway 28 therein, wherein the cavity 20 having an inner surface 21 is in fluid communication with the passageway 28. The upper end 16 of the receptacle body 12 includes an annular flange 30 extending away from the cavity 20 of the receptacle body 12. As shown in FIG. 7, the prior art floor sink 10 may also have a plurality of spaced apart anchor protrusions 32, preferably four (two are shown and two on an opposite side are not shown in FIG. 7) may be defined adjacent the upper end 16 of the receptacle body 12 underneath the flange 30 and extending in a direction away from the cavity 20 of the receptacle body 12. Each anchor protrusion 32 defines a passageway 34 which can be internally threaded and adapted to receive a fastener F for securing the receptacle body 12 to a floor. Referring back to FIG. 1, a grate 36 is typically placed over the upper end 16 of the open first portion 14 of the receptacle body 12 of the floor sink 10. A strainer 38 is typically received within the cavity 20 and positioned over the inlet end 24 of the second portion 22 of the receptacle body 12. The strainer 38, which can be a planer frame or dome-shaped frame, is typically seated on the inner surface 21 at the lower end 18 of the first portion 14 of the receptacle body 12.

One drawback to the prior art floor sink 10 is that the strainer 38 is not secured to the receptacle body 12 such that the strainer 38 can be easily removed. Oftentimes when these strainers 38 are either stolen or removed, vandals can then place debris directly in the pipe receiving second portion 22 of the receptacle body 12 thus clogging the floor sink 10.

Therefore, it is advantageous to overcome the above-mentioned drawbacks by providing a vandal-proof strainer arrangement that can be secured to the floor sink.

SUMMARY OF THE INVENTION

The present invention provides for a floor sink strainer arrangement adapted to fasten to a receptacle body of a floor sink. The strainer arrangement includes a strainer having a body and defining a slot therein for receiving a fastener, and a fastener arrangement attached to the strainer. The strainer is adapted to be received within the receptacle body of the floor sink. The fastener arrangement includes a support base and a longitudinal extending member attached to the base and extending therefrom, wherein the base is adapted to be secured to a drain pipe when the strainer is received within the receptacle body of the floor sink.

The present invention also provides for a vandal-proof strainer assembly that includes a receptacle body of a floor sink and a strainer arrangement as previously discussed. The receptacle body has an open first portion and a pipe receiving second portion. The first portion defines a cavity therein and the second portion having an inlet end and an outlet end defines a passageway therein, wherein the cavity is in fluid communication with the passageway. The outlet end of the second portion of the receptacle body is adapted to fasten to a drain pipe. The strainer is received within the cavity and positioned over the inlet end of the second portion of the receptacle body of the floor sink. The fastener arrangement is attached to the strainer via the fastener arrangement passing through the passageway of the second portion wherein the support base is adapted to be secured to a drain pipe and the extending member is received within the slot of the body of the strainer thereby securing the strainer to the receptacle body of the floor sink.

The present invention provides for a method of installing a vandal-proof strainer arrangement within a receptacle body of a floor sink. The method includes the steps of providing a receptacle body of a floor sink and a strainer as previously discussed. Next, a fastener arrangement as previously discussed is installed within the cavity of the receptacle body, wherein the extending member with the attached base passes through the passageway. The support base is positioned within a drain pipe and adapted to be secured thereto. A strainer having a body and defining a slot therein for receiving a fastener is attached to the fastener arrangement, wherein the strainer is received within the cavity and positioned over the inlet end of the second portion of the receptacle body of the floor sink. The first end of the extending member is received within the slot of the strainer body, thereby securing the strainer to the receptacle body of the floor sink.

DETAILED DESCRIPTION OF THE INVENTION

Figure 2:
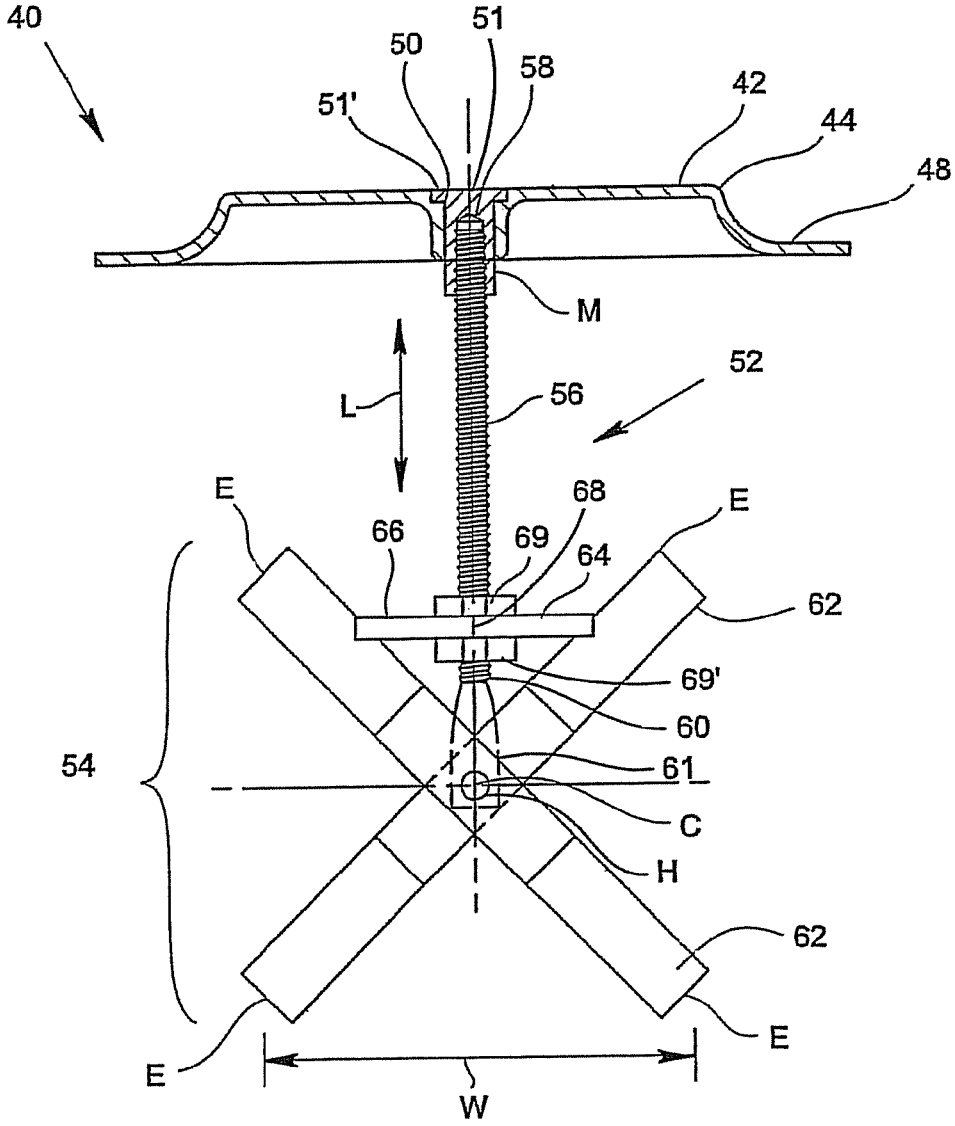
FIG. 2 is an elevational view of a floor sink strainer arrangement made in accordance with the present invention.
Figure 3:
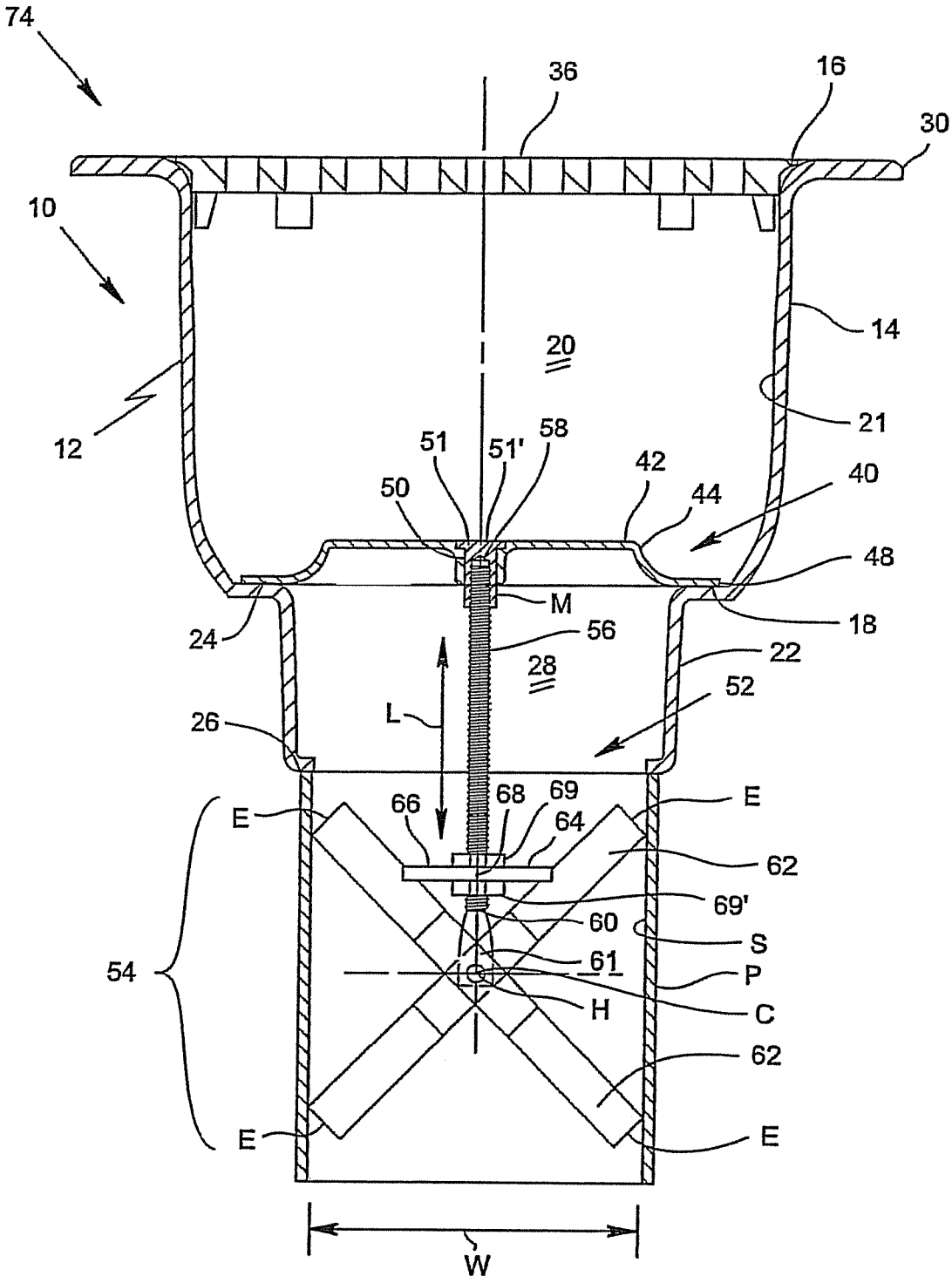
FIG. 3 is a cross-sectional view of the strainer arrangement shown in FIG. 2 installed in a receptacle body of a prior art floor sink.
Figure 4:
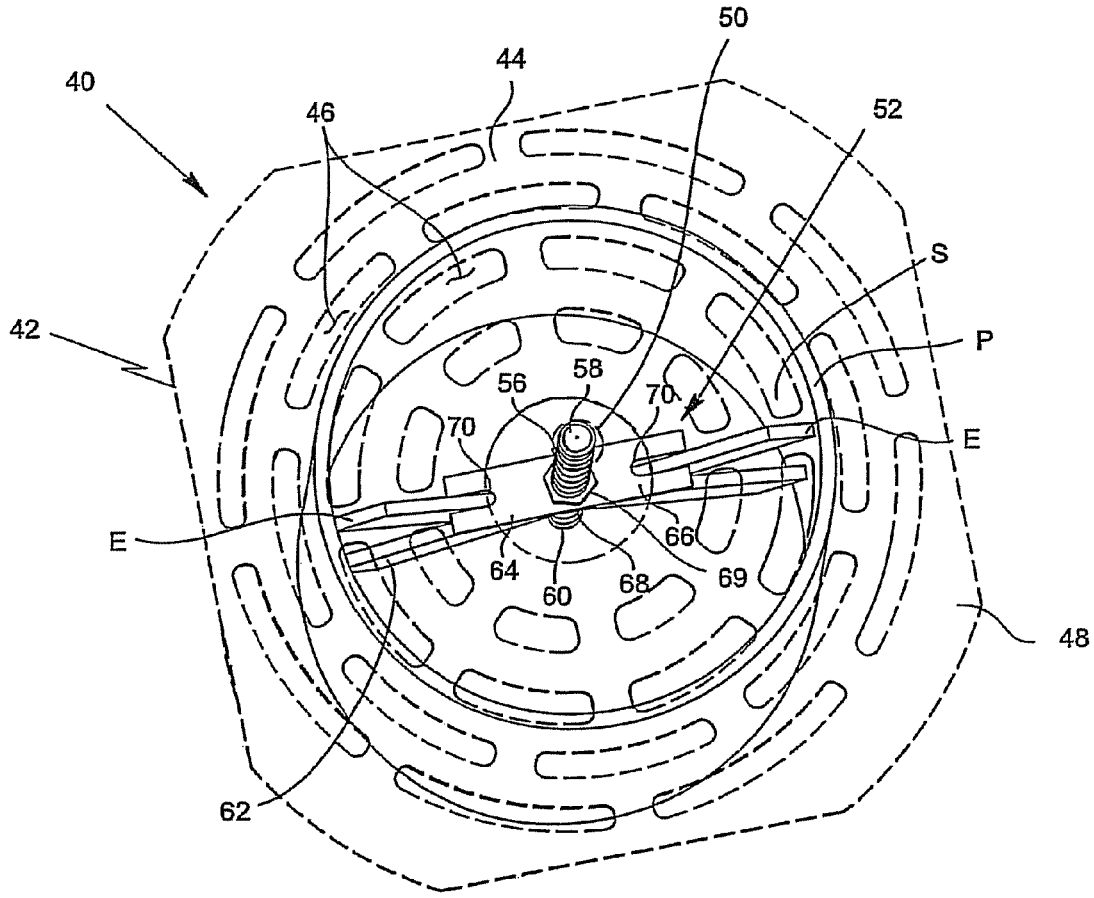
FIG. 4 is a top perspective view of a fastener arrangement of the floor sink strainer arrangement shown in FIG. 3 attached to a drain pipe.
Figure 5:
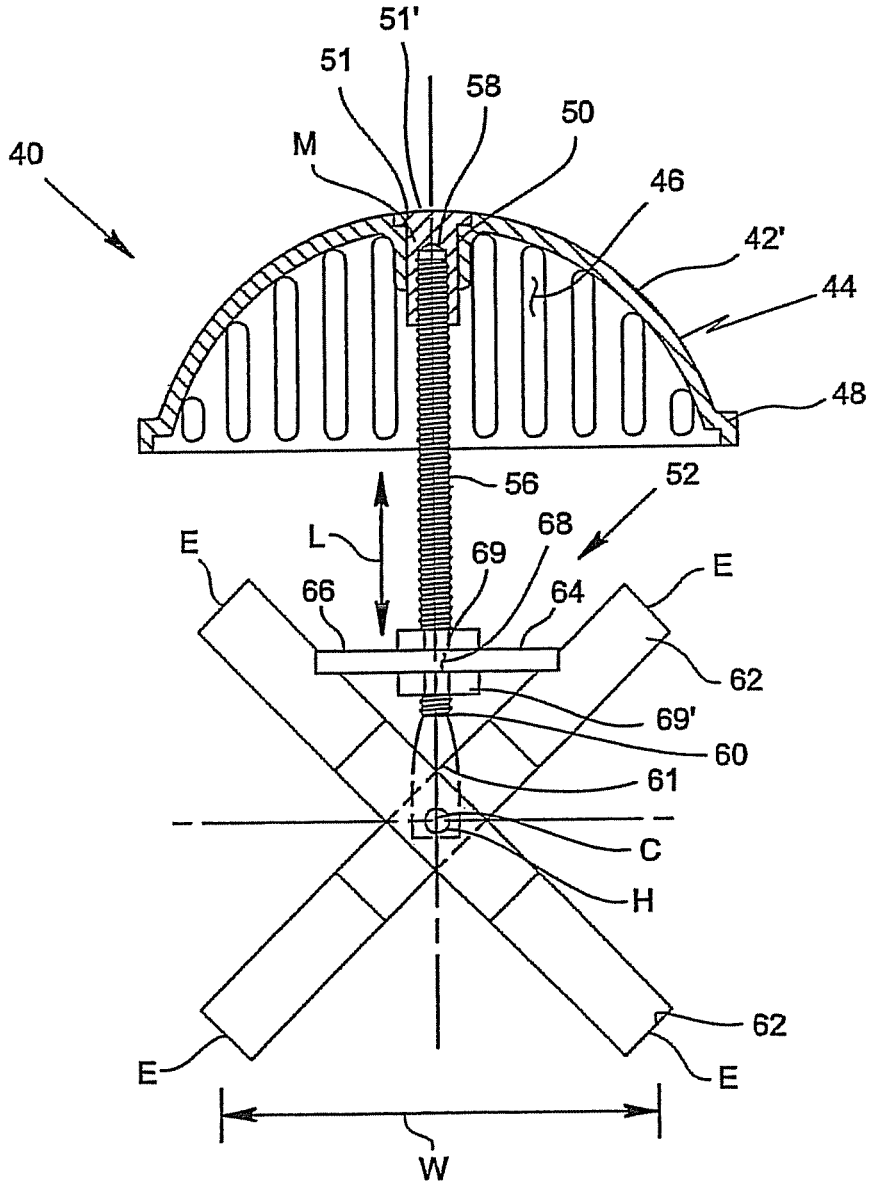
FIG. 5 is an elevational view, partially in section, of the floor sink strainer arrangement shown in FIG. 2 having a dome-shaped strainer.

Referring to FIGS. 2, 3 and 4, the present invention provides for a floor sink strainer arrangement 40 adapted to fasten to a receptacle body 12 of a prior art floor sink 10 as shown in FIG. 3. The strainer arrangement 40 includes a strainer 42 and a fastener arrangement 52 attached to the strainer 42. The strainer 42 (shown in phantom in FIG. 4) has a disc-shaped body 44 and defines a plurality of spaced apart elongated slots 46 adjacent to an annular flange 48 and defining a centrally positioned slot or hole 50 therein for receiving a fastener. The strainer 42 is adapted to be received within the cavity 20 of the receptacle body 12 of the floor sink 10. The strainer 42 can be planer or a dome-shaped strainer 42' (shown in FIG. 5).

Figure 2A:
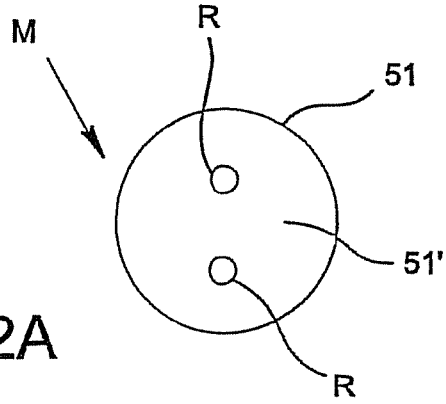
FIG. 2A is a top plan view of a threaded member of the strainer arrangement shown in FIG. 2.

Referring back to FIGS. 2, 3 and 4, the fastener arrangement 52 includes a support base 54 and a longitudinal extending member (preferably a threaded fastener 56) having a first end 58 and a second end 60 attached to the support base 54 and extending therefrom. The first end 58 of the fastener 56 is received within the slot 50 of the body 44 of the strainer 42. The slot 50 can either be internally threaded or an internally threaded member M can be received within the slot 50 for attaching the threaded fastener 56 to the strainer 42. The threaded member M has a cap portion 51, wherein a plurality of recesses R is preferably defined on a top surface 51' (shown in FIG. 2A) that can be used to rotate the threaded member M. When the fastener arrangement 52 is attached to the strainer 42, the top surface 51' of the cap portion 51 is flush with a top surface of the strainer body 44. A custom tool having prongs that can be received in the recesses R of the cap portion 51 has to be used to rotate the threaded member M when the strainer 42 is installed. Other types of uncommon shapes may be used on the cap portion 51, such as, a star recess wherein a custom tool that includes a star-shaped member is adapted to mate with the recess for tightening and loosening. This prevents vandals from using a common tool such as a screw driver to unscrew the threaded member M and remove the strainer 42.

With continued reference to FIGS. 2, 3 and 4, the support base 54 of the fastener arrangement 52 includes a plurality of cross bars 62 (preferably two) pivotably attached to each other at a center C thereof. The second end 60 of the fastener 56 having a flat portion 61 (shown in phantom) and defining a hole H therein is attached at the center C of the cross bars 62. The flat portion 61 is positioned between the cross bars 62 and a mechanical fastener such as screw or pin passes through the cross bars 62 and the hole H thereby securing the fastener 56 to the cross bars 62. A nut and bolt arrangement having washers sandwiched therebetween may also be used for pivotably attaching the fastener 56 to the cross bars 62. The support base 54 also includes an adjustable member 64 having a rectangular-shaped body 66 and defining an opening 68 therein. At least one adjustable nut 69 (referred to as a jam nut) is preferably positioned on one side of the body 66 of the adjustable member 64. The jam nut 69 may be a hex nut. A second nut or jam nut 69' may be positioned on an opposite side of the body 66 of the adjustable member 64. Nuts 69 and 69' are threadably received by the threaded fastener 56. An open-ended slot 70 is defined on each end of the body 66 of the adjustable member 64 as shown in FIG. 4. The threaded fastener 56 extends through the opening 68 of the adjustable member 64, wherein the jam nuts 69, 69' are positioned on each side of the adjustable member 64. Rotation of the jam nuts 69, 69' forces the adjustable member 64 to move longitudinally along a length of the fastener 56 between the first end 58 and the second end 60. As the adjustable member 64 moves toward the second end 60 of the fastener 56, each of the open-ended slots 70 of the body 66 receives a portion of one of the cross bars 62 wherein movement of the adjustable member 64 pivotably moves the cross bars 62 thus contacting the inner surface S of the drain pipe P. As the jam nut 69 is tightened, an end or edge E of the cross bars 62 engages the inner surface S of the drain pipe P thus securing the cross bars 62. Jam nut 69' may also be tightened against an underside of the adjustable member 64 to lock it in place. Rotation of the nuts 69, 69' may be done using a common tool such as a wrench.

Figure 1:
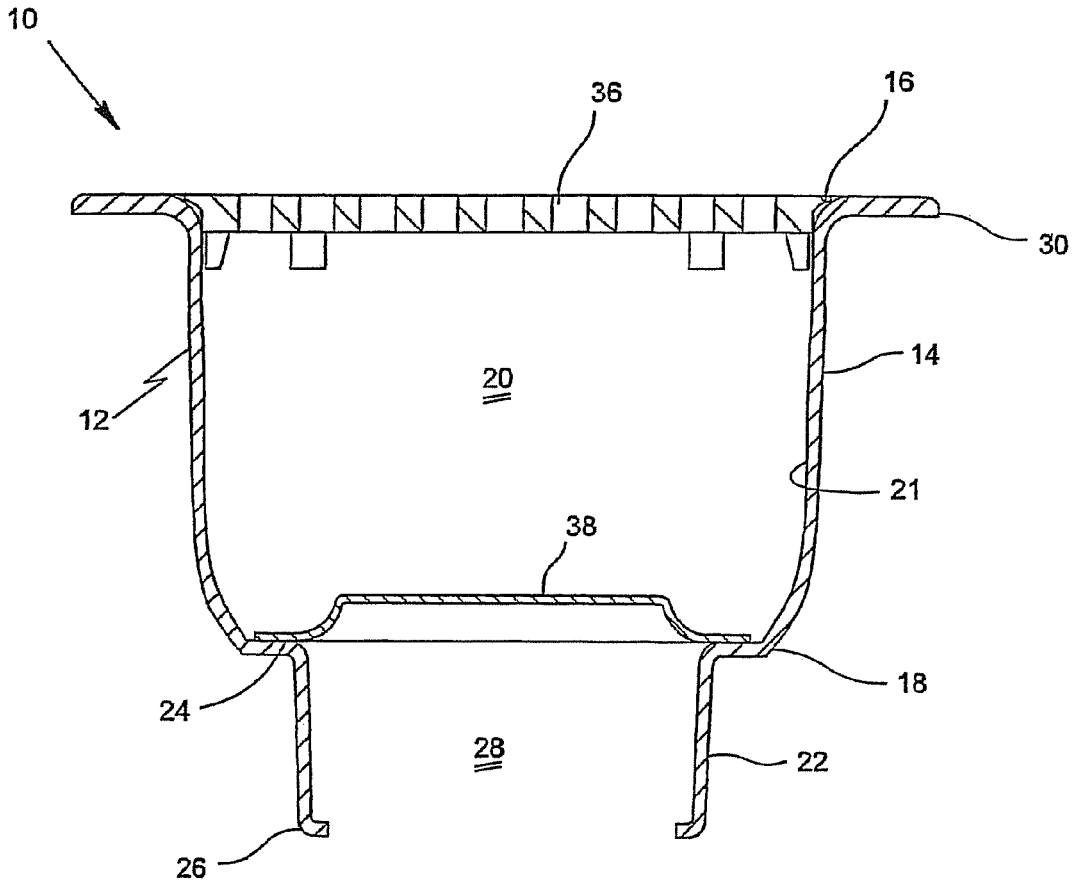
FIG. 1 (PRIOR ART)
FIG. 1 is cross-sectional view of a prior art receptacle body of a floor sink.

Referring to FIG. 3, the present invention provides for a vandal-proof strainer assembly 74 that includes a strainer arrangement 40 as previously discussed attached to a receptacle body 12 of a prior art floor sink 10 (shown in FIG. 1) via a fastener arrangement 52. When the floor sink 10 is installed in a floor, the outlet end 26 of the second portion 22 is attached to a drain pipe P. The fastener arrangement 52 passes through the passageway 28 of the second portion 22, wherein the support base 54 is received within the drain pipe P. Upon rotation of the jam nuts 69, 69' wherein the adjustable member 64 moves toward the second end 60 of the threaded fastener 56, the cross bars 62 are pivotably moved by the adjustable member 64 such that the cross bars 62 engage an inner surface S of the drain pipe P. The first end 58 of the threaded fastener 56 is received within the slot 50 or the threaded member M within the slot 50 of the strainer body 44 thereby securing the strainer 38 within the receptacle body 12 of the floor sink 10. The cross bars 62 of the support base 54 can be any length to accommodate various diameters of drain piping. The drain pipe P is typically made of cast iron such that the edges E of the cross bars 62 can dig into the cast iron thereby securing the support base 54 to the drain pipe P.

The present invention provides for a method of installing a vandal-proof strainer arrangement 40 within a receptacle body 12 of a prior art floor sink 10. Referring to FIGS. 2, 3 and 4, the method includes the steps of providing a receptacle body 12 and a strainer 42 as previously discussed. A fastener arrangement 52 is installed within the cavity 20 of the receptacle body 12 wherein the threaded fastener 56 with the attached support base 54 passes through the passageway 28 such that the support base 54 is positioned within a drain pipe P and adapted to be secured thereto. The jam nuts 69, 69' are then rotated such that the adjustable member 64 moves toward the second end 60 of the threaded fastener 56 thereby pivotably moving the cross bars 62 to increase its width W. As the jam nut 69, is tightened, the cross bar edges E dig into the inner surface S of the drain pipe thus securing the cross bars 62 to the drain pipe P. Next, the strainer 42 having a body 44 and defining a slot 50 therein for receiving a fastener or threaded member M is received within the cavity 20 and positioned over the inlet end 24 of the second portion 22 of the receptacle body 12 of the floor sink 10. Lastly, the strainer 42 is then attached to the fastener arrangement 52, via the first end 58 of the threaded fastener 52 threadably received within the slot 50 or threaded member M of the strainer body 44 thereby securing the strainer 42 to the receptacle body 12 of the floor sink 10. The strainer 42 can be further tightened by rotating the strainer 42 or the threaded member M via using a custom tool having prongs that can be inserted into the recesses R of the top surface 51' of the cap portion 51 of the threaded member M.

Figure 6:
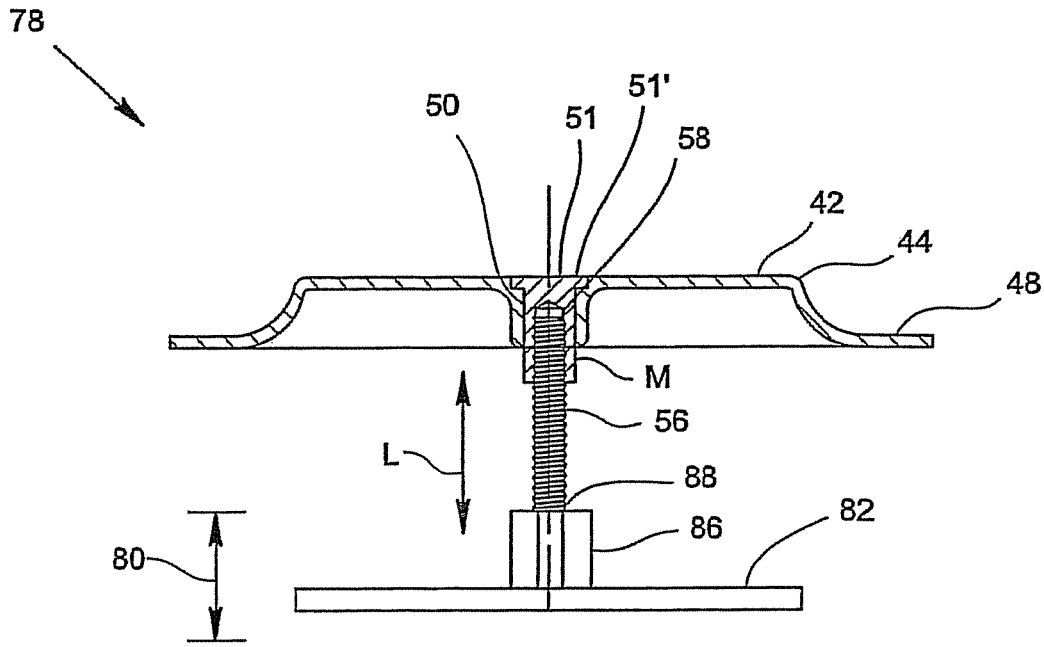
FIG. 6 is an elevational view, partially in section, of a second embodiment of a floor sink strainer arrangement made in accordance with of the present invention.
Figure 7:
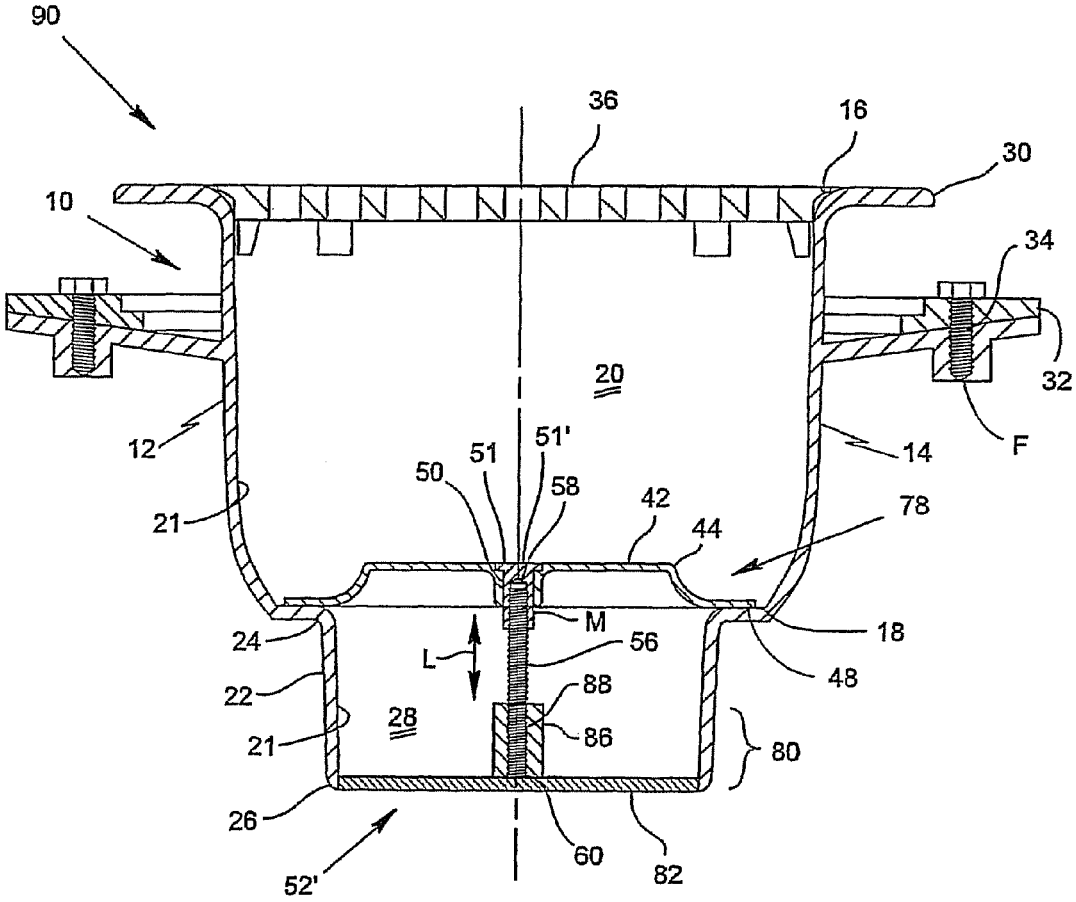
FIG. 7 is a partial cross-sectional view of the strainer arrangement shown in FIG. 5 installed in a receptacle body of a prior art floor sink.
Figure 8:
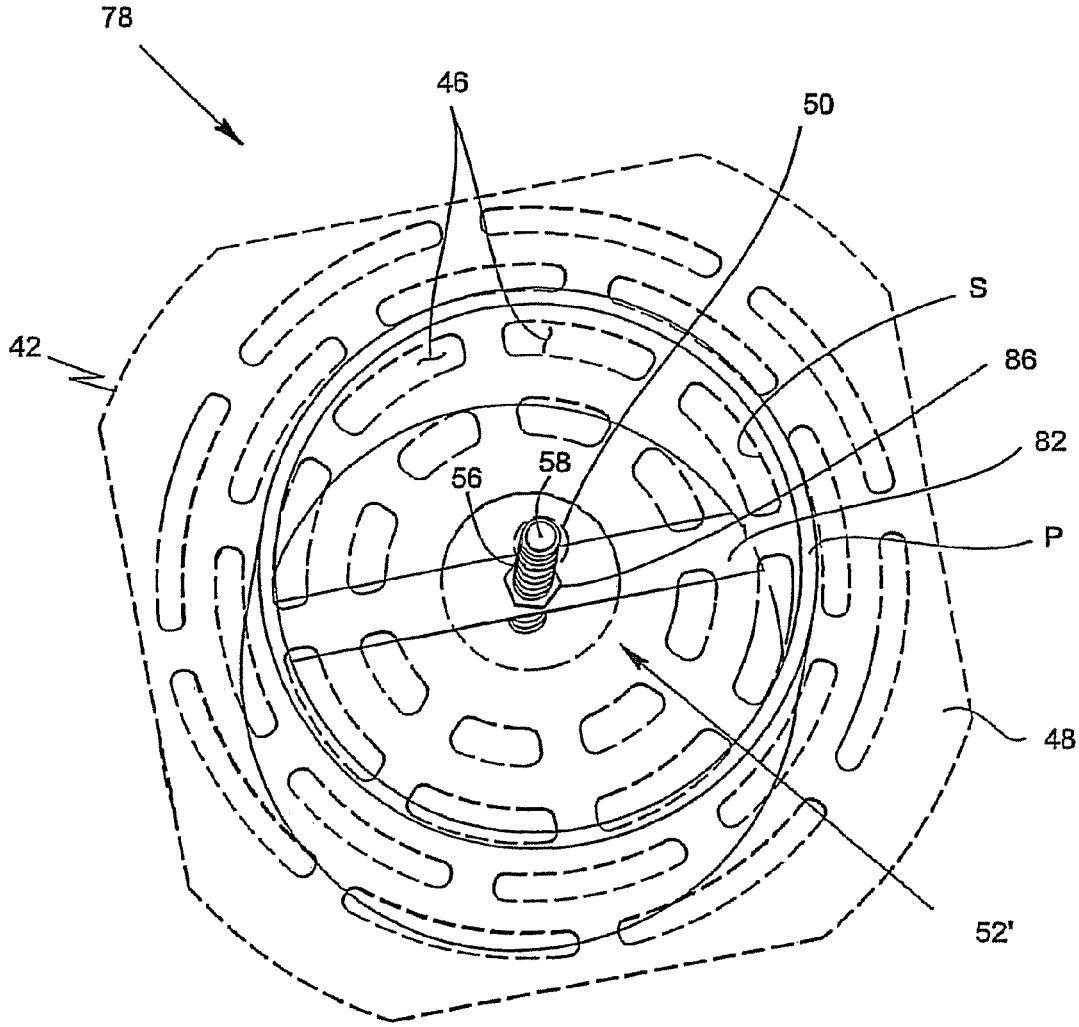
FIG. 8 is a top perspective view of a fastener arrangement of the floor sink strainer arrangement shown in FIG. 7.

Referring to FIGS. 6, 7 and 8, a second embodiment of the present invention provides for a strainer arrangement 78 that is similar to strainer arrangement 40, except for the differences noted below. Like reference numerals are used for like parts. The strainer arrangement 78 also includes a longitudinal extending member or preferably a threaded fastener 56 having a first end 58 and a second end 60, wherein the second end 60 of the fastener 56 is threadably attached to a support base 80. The difference between arrangement 40 and arrangement 78 is that the support base 80 of arrangement 78 includes an extended bar 82 and an elongated nut 86 having an internally threaded slot 88 therein centrally attached to the extended bar 82. The second end 60 of the threaded fastener 56 is threadably received with the slot 88 of the nut 86. The extended bar 82 extends through the passageway 28 and is attached to an inner surface 21 of the second portion 22 adjacent the outlet end 26 of the receptacle body 12 of the floor sink 10. The extended bar 82 can be welded or mechanically fastened such as bolted at its ends to the second portion 22 of the receptacle body 12 of the floor sink 10. A length of the threaded fastener 56 can be adjusted into a desired position upon rotation such that the first end 58 of the fastener 56 extends slightly above the inlet end 24 of the receptacle body 12. The second end 60 of the threaded fastener 56 can abut against the bar 82 thus preventing the fastener 56 from further rotation. The first end 58 of the threaded fastener 56 is threadably received within the slot 50 or the threaded member M within the slot 50 of the strainer body 44, thereby securing the strainer 42 to the receptacle body 12 of the floor sink 10. The strainer 42 can be further tightened by rotating the strainer 42 or the threaded member M as previously discussed.

Referring to FIG. 7, the present invention provides for a vandal-proof strainer assembly 90 that includes a strainer arrangement 78 as previously discussed attached to a receptacle body 12 of a floor sink 10 via a fastener arrangement 52'. When the floor sink 10 is installed in a floor, the fastener arrangement 52' passes through the passageway 28 and the extended bar 82 of the support base 80 is attached to the second portion 22 of the receptacle body 12 adjacent the outlet end 26. The threaded fastener 56 is rotated until the first end 58 of the threaded fastener 56 extends slightly above the inlet end 24 of the second portion 22 and the second end 60 abuts against the extended bar 82 thus preventing the threaded fastener 56 from further rotation. The first end 58 of the threaded fastener 56 is threadably received within the slot 50 or an internally threaded member M within the slot 50 of the strainer body 44. When the threaded member M is used, the cap portion 51 is threaded onto the first end 58 of the fastener 56 and tightened, thereby securing the strainer 42 to the receptacle body 12 of the floor sink 10.

The present invention provides for a method of installing a vandal-proof strainer arrangement 78 which is similar to the method for installing strainer arrangement 40 within a receptacle body 12 of a floor sink 10, except that the extended bar 82 of the support base 80 attaches to the second portion 22 of the receptacle body 12 of a floor sink 10 adjacent the outlet end 26 thereof. Attachment of the support base 80 to the receptacle body 12 can occur prior to installation of the floor sink 10 into a floor structure.

Figure 9:
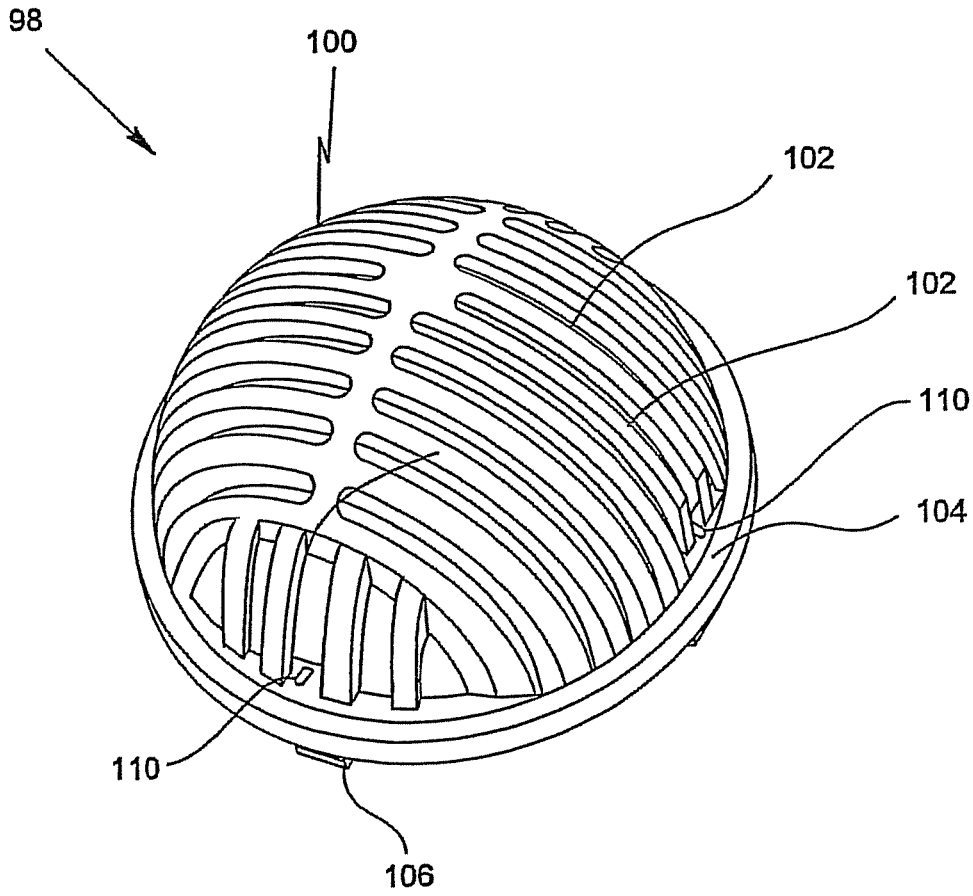
FIG. 9 is a top perspective view of a vandal-proof strainer made in accordance with a third embodiment of the present invention.
Figure 10:
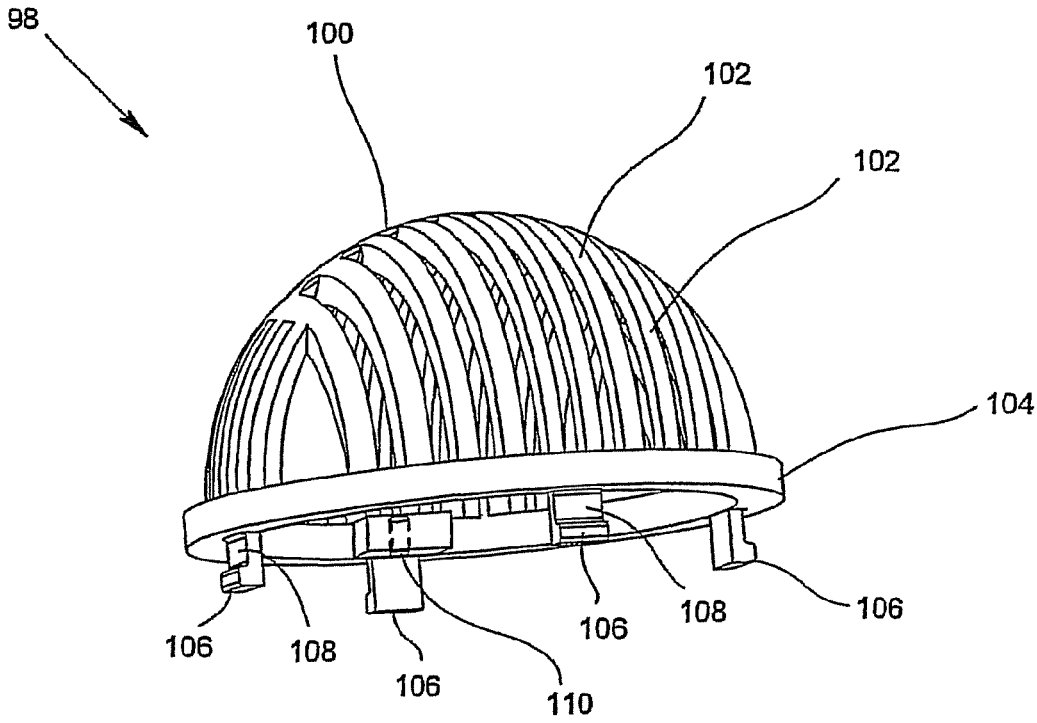
FIG. 10 is an elevational side view of the vandal-proof strainer shown in FIG. 9.
Figure 11:
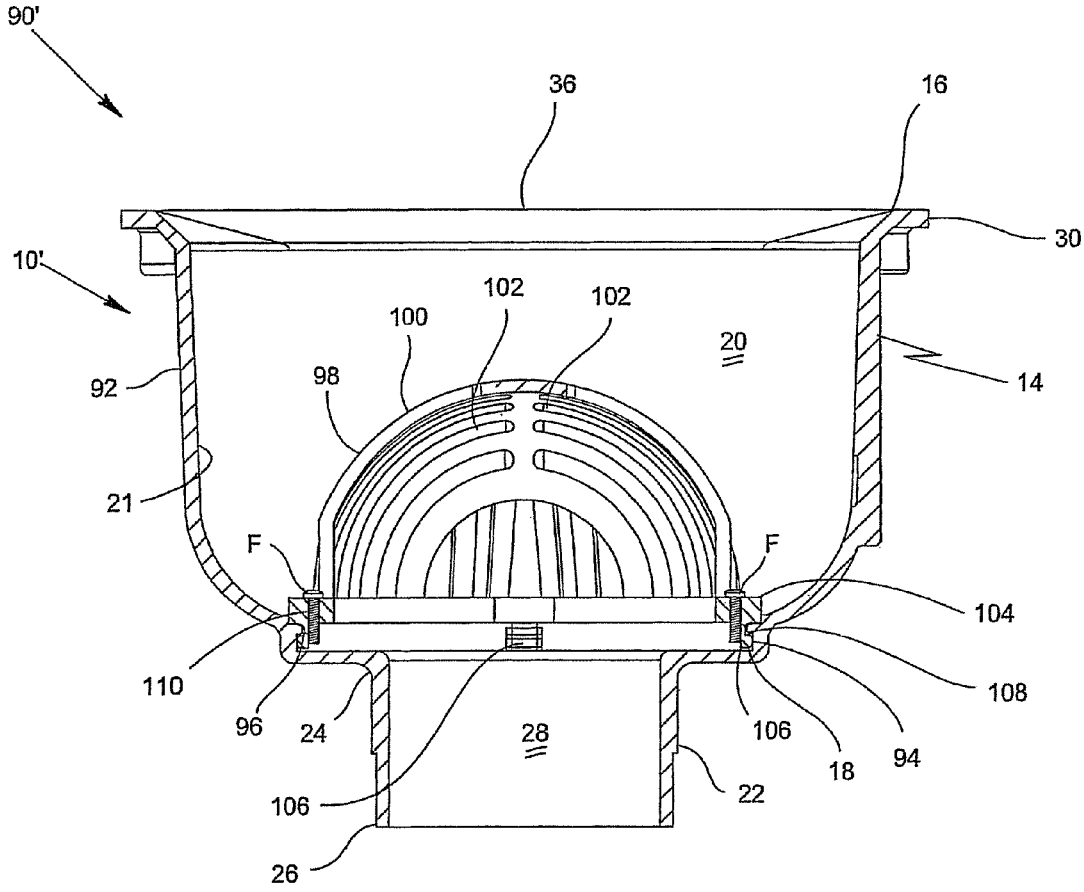
FIG. 11 is a cross-sectional view of a strainer assembly made in accordance with the present invention utilizing the vandal-proof strainer shown in FIG. 9.

Referring to FIGS. 9, 10 and 11, the present invention also provides for a second embodiment of a vandal-proof strainer assembly 90' that includes a strainer 98 according to a third embodiment of the present invention and a receptacle body 92 of a floor sink 10' that is similar to the prior art receptacle body 12 except for the differences noted below. Like reference numerals are used for like parts. The difference between the receptacle body 92 and the receptacle body 12 is that the lower end 18 of the cavity 20 of the first portion 14 of the receptacle body 92 has a ledge 94 and defines an annular protrusion 96 extending away from the ledge 94. Preferably, the receptacle body 92 is made of metal, however the annular protrusion 96 may be made of a resilient, flexible material such as rubber or plastic. The strainer 98 has a body 100 and defines a plurality of spaced apart longitudinal extending members 102 attached to an annular flange 104 at each end thereof. The extending member 102 can be concave shaped thus forming a dome-shaped strainer (shown in FIGS. 9 and 10) or flat thus forming a planer strainer (not shown). The annular flange 104 has at least one lug portion 106 (preferably four lug portions) which extends axially away from the annular flange 104. Each lug portion 106 defines a groove 108 between the annular flange 104 and a portion of the lug portion 106, wherein the annular protrusion 96 is received within the groove 108 of the lug portion 106 when the body 100 of the strainer 98 is received within the cavity 20 and positioned on the ledge 94 of the lower end 18 of the first portion 14 over the inlet end 24 of the second portion 22 of the receptacle body 92 of the floor sink 10'. The annular flange 104 of the strainer body 100 further defines a slot 110 adjacent the lug portion 106, wherein the slot 110 is adapted to receive a fastener F such as a screw for securing the strainer 98 to the receptacle body 92 of the floor sink 10'. The slot 110 can be internally threaded for receiving a threaded fastener F. The threaded fastener F is preferably a non-standard screw (i.e., referred to as a vandal-proof screw) thereby preventing vandals from unscrewing the fastener F using a common tool such as a standard flathead or Philips head screw driver. The head section of the vandal-proof screw can be, for example, snake-eyes (shown in FIG. 2A) adapted to mate with a two prong tool or a star type adapted to mate with a star-shaped member. The lug portions 106 may be flexible as well as resilient and can be flexed when the strainer 98 is pushed over the ledge 94, so that the ledge 94 is captured in the groove 108. An advantage of the vandal-proof strainer assembly 90' is that there is no structure of objects positioned below the strainer 98 such that the flow of material through the floor sink 10' is not obstructed such as shown in the prior two embodiments.

In operation, the strainer 98 is snap-fitted on the ledge 94 over the inlet end 24 of the second portion 22 of the receptacle body 92 such that the annular protrusion 96 is received within each groove 108 of the lug portions 106 of the strainer 98. A fastener F is placed within the slot 110 such that the fastener F prevents the lug portions 106 from bending or flexing such that the annular protrusion 96 is removed from the groove 108 of the lug portion 106 thereby releasing the snap fitted attachment of the strainer 98 to the receptacle body 92 of the floor sink 10'. Preferably the fastener F is made of metal. Preferably, the lug portions 106 are made of a flexible and resilient material such as a polymeric material. Likewise, the complete receptacle body 92 may be made of a polymeric material.

Figure 12:
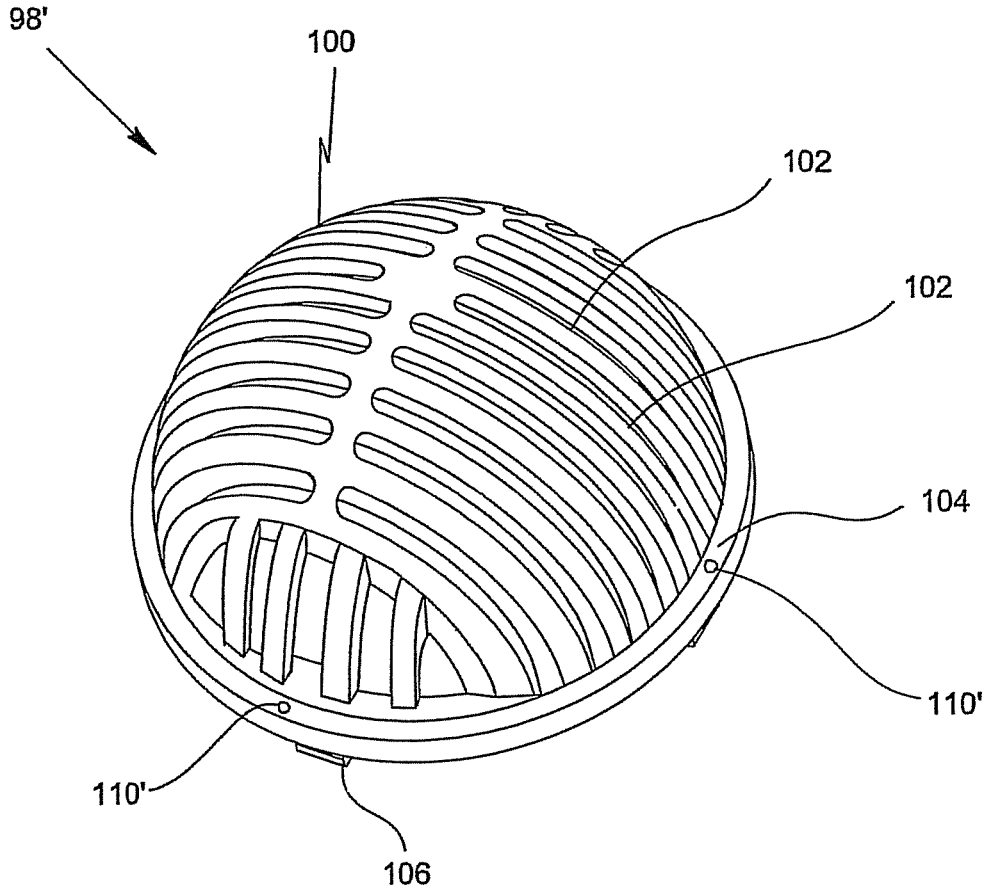
FIG. 12 is a top perspective view of a vandal-proof strainer made in accordance with a fourth embodiment of the present invention.
Figure 13:
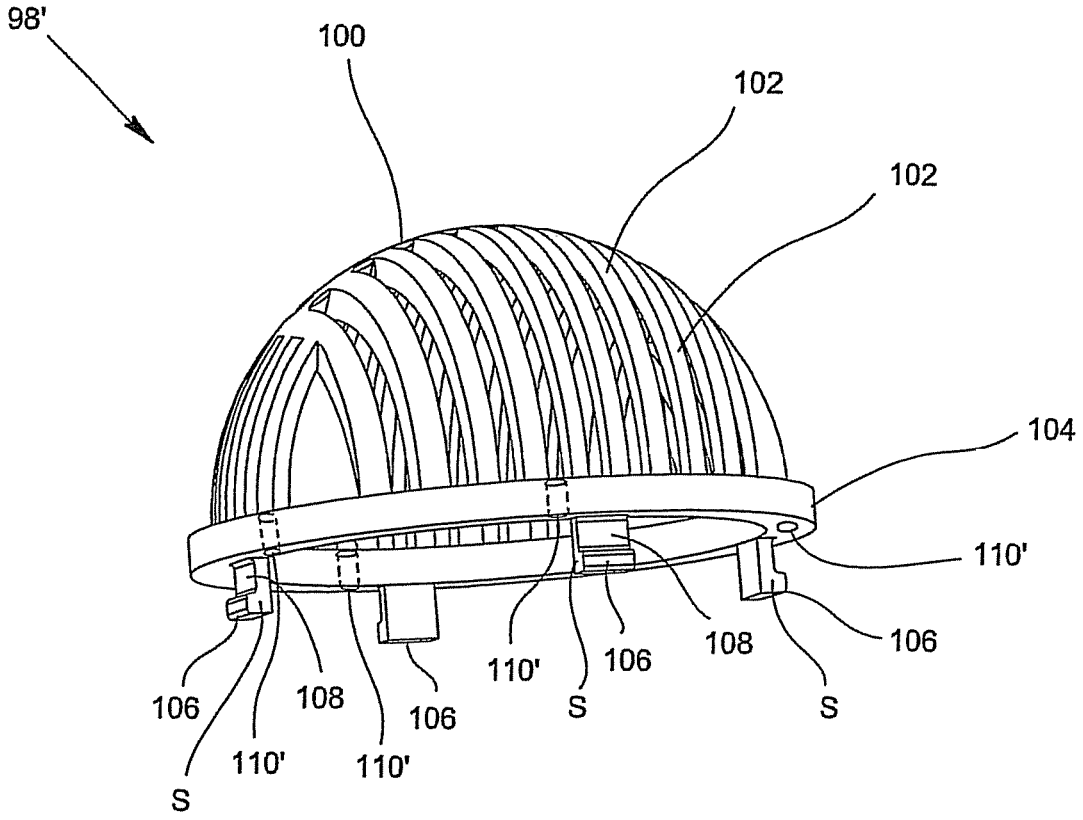
FIG. 13 is an elevational side view of the vandal-proof strainer shown in FIG. 12.
Figure 14:
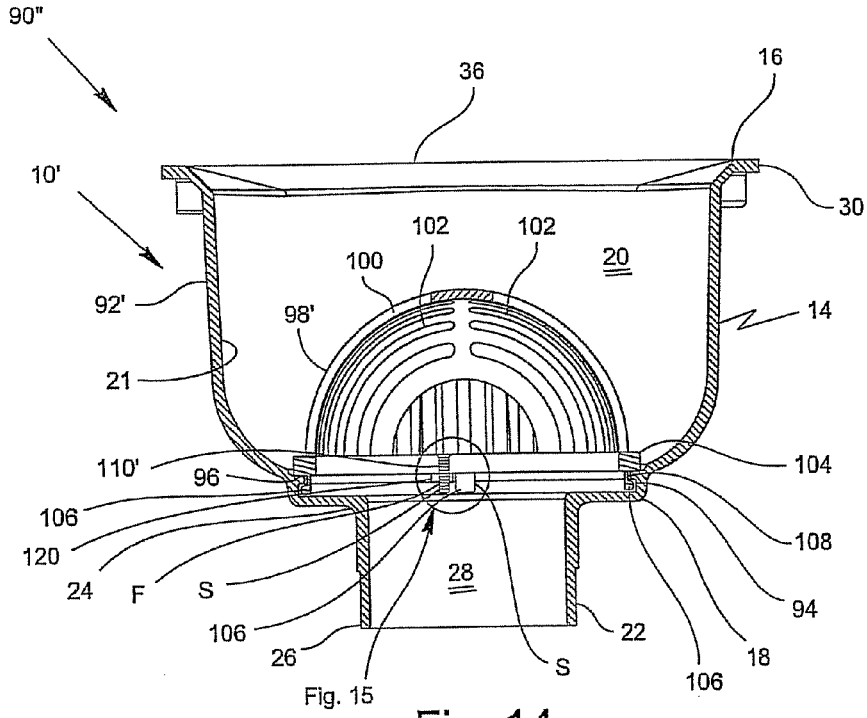
FIG. 14 is a cross-sectional view of a strainer assembly made in accordance with a second embodiment of the present invention utilizing the vandal-proof strainer shown in FIG. 12.
Figure 15A:
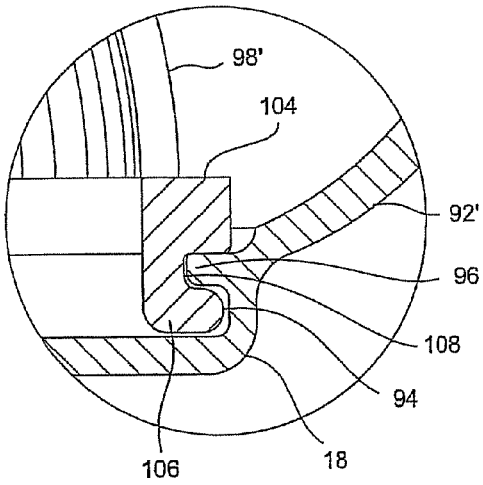
FIG. 15A is an exploded view of an attachment section of the strainer assembly shown in FIG. 14.
Figure 15:
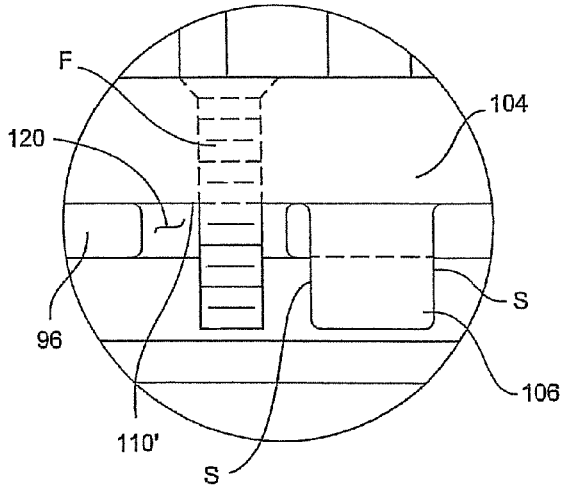
FIG. 15 is an exploded view of a fastener arrangement of the strainer assembly shown in FIG. 14.
Figure 16:
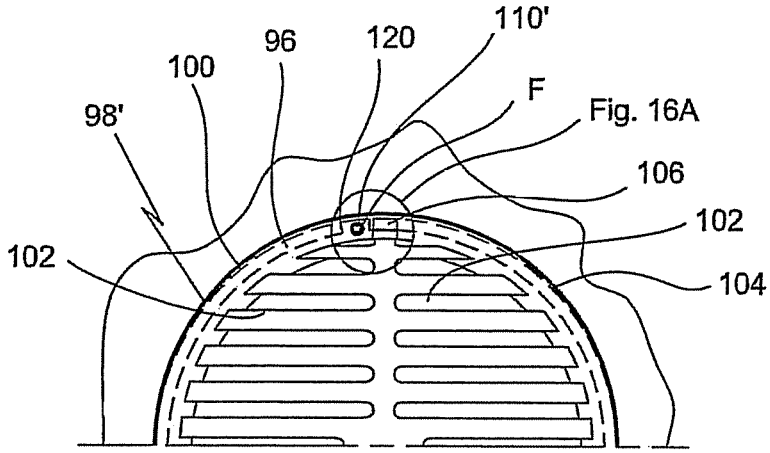
FIG. 16 is a top view of a portion of the strainer assembly shown in FIG. 14.
Figure 16A:
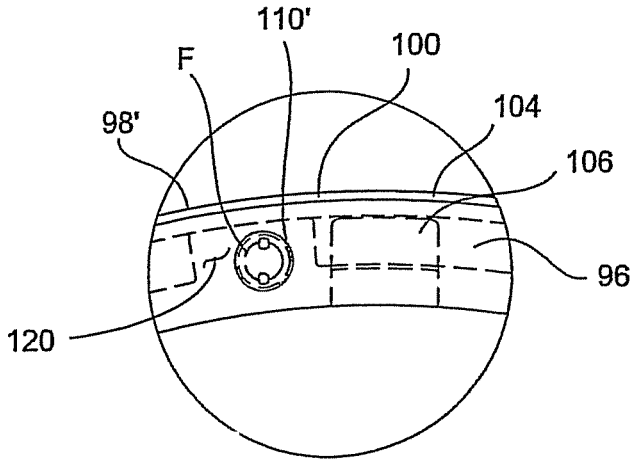
FIG. 16A is an exploded view of a fastener arrangement of the strainer assembly shown in FIG. 16.

Referring to FIGS. 12-16, the present invention also provides for a third embodiment of a vandal-proof strainer assembly 90" that includes a receptacle body 92' and a vandal-proof strainer 98' that is similar to strainer 98 and receptacle body 92 of strainer assembly 90', except for the differences noted below. Like reference numerals are used for like parts. The difference between the receptacle body 92' and the receptacle body 92 is that at least one cutout 120 is defined in the annular protrusion 96 of receptacle body 92' for receiving a lug portion 106 of the strainer 98' as shown in FIGS. 16 and 16A. Preferably, the number and position of the cutouts 120 correspond to the number and position of the lug portions 106 of the strainer 98'. The annular protrusion 96 of receptacle body 92' is preferably made of a resilient material such as metal. The difference between strainer 98' and strainer 98 is that at least one slot 110', which is defined in the annular flange 104, is positioned adjacent a sidewall S of the lug portion 106 of strainer 98' as shown in FIGS. 12 and 13. The lug portions 106 of strainer 98' may be made of a resilient material such as metal, but also may be made of a flexible material as well.

In operation, the strainer 98' is positioned on the ledge 94 over the inlet end 24 of the second portion 22 of the receptacle body 92' such that each lug portion 106 is received within the cutouts 120 of the receptacle body 92'. The strainer 98' is then rotated represented by arrow R such that the annular protrusion 96 is received within each groove 108 of the lug portions 106 of the strainer 98'. Referring to FIGS. 14, 15 and 15A, a fastener F such as a vandal-proof screw as previously discussed is placed within the slot 110' such that the fastener F prevents the strainer 98' from further rotation thereby releasing the attachment of the strainer 98 to the receptacle body 92' of the floor sink 10'. An advantage of strainer assembly 90" is that only one fastener F need be used to prevent the strainer 98' from further rotation.

Finally, vandal-proof fastening members M and F should have unique head shapes or recesses for engaging with special tool heads to enhance the vandal-proof nature of the present invention. However, it is also conceivable that the fastening members M and F can take on common shapes such as a hex shape, a slot for a flat head screw driver or a slot for a Phillips head screw driver.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. A floor sink strainer arrangement adapted to fasten to a receptacle body of a floor sink, the strainer arrangement comprising:

a strainer having a body and defining a slot that extends through the body, said strainer adapted to be received within the receptacle body of the floor sink; and a fastener arrangement attached to said strainer, said fastener arrangement comprising a support base and a longitudinal extending member attached to said base and extending therefrom, wherein said base is adapted to be secured to a drain pipe when said strainer is received within the receptacle body of the floor sink, said extending member comprising a threaded fastener having a first end and a second end and a threaded member, said threaded member comprising a body and a flange extending radially outward from the body, said body of said threaded member defining an opening, said flange of said threaded member engaging the body of said strainer, said first end of said threaded fastener received by said opening of said threaded member, said body of said threaded member received within the slot of said body of said strainer, and wherein said support base comprises an extended bar and an elongated nut centrally attached to said bar, said second end of said threaded fastener threadably attached to said nut, said support base adapted to be attached to an outlet end of the receptacle body of the floor sink.

2. The strainer arrangement as claimed in claim 1, wherein said body of said strainer is disc-shaped.

3. The strainer arrangement as claimed in claim 1, wherein said body of said strainer is dome-shaped.

4. A vandal-proof strainer assembly comprising:

a receptacle body of a floor sink, said receptacle body having an open first portion and a pipe receiving second portion, said first portion defining a cavity therein, said second portion having an inlet end and terminating at an outlet end, said second portion defining a passageway between said inlet end and said outlet end, wherein the cavity is in fluid communication with the passageway, said outlet end of said second portion of said receptacle body adapted to fasten to a drain pipe;

a strainer having a body and defining a slot therein, said strainer received within the cavity and positioned over said inlet end of said second portion of said receptacle body of said floor sink; and a fastener arrangement attached to said strainer, said fastener arrangement comprising a support base and a longitudinal extending member attached to said base and extending therefrom, said fastener arrangement passing through the passageway of said second portion and said base secured to said receptacle body at said outlet end of said second portion of said receptacle body, wherein said extending member is received within the slot of said body of said strainer thereby securing said strainer to said receptacle body of said floor sink.

5. The strainer assembly as claimed in claim 4, wherein said extending member comprises a threaded fastener having a first end and a second end, said first end of said threaded fastener received within the slot of said body of said strainer.

6. The strainer assembly as claimed in claim 5, wherein said support base comprises an extended bar and an elongated nut centrally attached to said bar, said second end of said threaded fastener threadably attached to said nut.

7. The strainer assembly as claimed in claim 4, wherein said body of said strainer is disc-shaped.

8. The strainer assembly as claimed in claim 4, wherein said body of said strainer is dome-shaped.

* * * * *